US008834984B2

(12) United States Patent
Wildeman

(10) Patent No.: US 8,834,984 B2
(45) Date of Patent: Sep. 16, 2014

(54) STITCH BONDED WIPE

(75) Inventor: Martin Wildeman, Spartanburg, SC (US)

(73) Assignee: Tietex International, Ltd, Spartanburg, SC (US)

( * ) Notice: Subject to any disclaimer, the term of this patent is extended or adjusted under 35 U.S.C. 154(b) by 881 days.

(21) Appl. No.: 12/973,216

(22) Filed: Dec. 20, 2010

(65) Prior Publication Data

US 2011/0146017 A1 Jun. 23, 2011

Related U.S. Application Data

(60) Provisional application No. 61/289,192, filed on Dec. 22, 2009.

(51) Int. Cl.

| | |
|---|---|
| ***D05B 95/00*** | (2006.01) |
| ***D04B 21/20*** | (2006.01) |
| ***B32B 5/26*** | (2006.01) |
| ***D04H 3/05*** | (2006.01) |
| ***D05B 3/00*** | (2006.01) |
| ***D04B 21/16*** | (2006.01) |
| ***D04B 21/14*** | (2006.01) |
| ***D04H 3/115*** | (2012.01) |

(52) U.S. Cl.

CPC ..... *D05B 3/00* (2013.01); *D04B 21/165* (2013.01); *D04B 21/14* (2013.01); *D04H 3/115* (2013.01)

USPC ..... 428/107; 428/108; 442/336; 442/319; 442/312; 112/402; 112/412; 112/415; 112/417

(58) Field of Classification Search

CPC ..... D04B 21/14; D04B 21/16; D04H 1/52; D04H 3/115

USPC ..... 428/107, 108; 442/366, 319, 312; 112/402, 412, 415, 417

See application file for complete search history.

(56) References Cited

U.S. PATENT DOCUMENTS

| | | | | |
|---|---|---|---|---|
| D188,408 | S | 7/1960 | Slegman | |
| 3,392,078 | A | 7/1968 | Duhl | |
| D272,673 | S | 2/1984 | Bonomo | |
| 4,773,238 | A | 9/1988 | Zafiroglu | |
| 5,203,186 | A * | 4/1993 | Zafiroglu | 66/192 |
| D376,896 | S | 12/1996 | O'Rorke | |
| 5,725,927 | A | 3/1998 | Zig et al. | |

(Continued)

OTHER PUBLICATIONS

International Preliminary Report on Patentability—PCT/US2010/061485—Jun. 26, 2012.

(Continued)

*Primary Examiner* — Jenna Johnson

(74) *Attorney, Agent, or Firm* — J. M. Robertson, LLC

(57) ABSTRACT

A disinfecting cleaning wipe of stitch-bonded construction. The wipe includes a stitching substrate of fibrous nonwoven material having a mass per unit area of not more than 30 grams per square meter. A first plurality of stitching yarns is disposed in stitched relation through the stitching substrate in a pattern of substantially parallel linear stitch lines extending in a first direction across the stitching substrate. At least a second plurality of stitching yarns is disposed in stitched relation through the stitching substrate in a repeating zigzag pattern to define a first group of surface yarn float segments extending diagonally between stitch positions at opposing linear stitch lines. A disinfecting solution at least partially saturates the cleaning wipe.

10 Claims, 7 Drawing Sheets

(56) References Cited

U.S. PATENT DOCUMENTS

| | | | |
|---|---|---|---|
| 6,202,250 | B1 | 3/2001 | Kenmochi et al. |
| 6,423,165 | B1 | 7/2002 | Hishinuma |
| 6,855,220 | B2 | 2/2005 | Wildeman |
| 6,855,392 | B2 | 2/2005 | Wildeman |
| D505,528 | S | 5/2005 | Burt et al. |
| D545,018 | S | 6/2007 | Caruso et al. |
| D552,313 | S | 10/2007 | Caruso et al. |
| 7,294,387 | B2 | 11/2007 | Wildeman |
| D581,677 | S | 12/2008 | Yeh |
| D609,420 | S | 2/2010 | Lafortezza |
| D627,941 | S | 11/2010 | Cocchioni |
| D633,673 | S | 3/2011 | McKnight |
| 2006/0212014 | A1 | 9/2006 | Balogh |
| 2008/0280094 | A1 | 11/2008 | Wildeman |
| 2010/0057032 | A1 | 3/2010 | Hardegree |
| 2010/0147203 | A1 | 6/2010 | MacDonald |
| 2010/0263152 | A1 | 10/2010 | Wildeman |
| 2010/0263154 | A1 | 10/2010 | Wildeman |
| 2011/0028936 | A1 | 2/2011 | Wildeman |

OTHER PUBLICATIONS

International Search Report and Written Opinion in international Application No. PCT/US 10/61485.

* cited by examiner

STITCH BONDED WIPE

CROSS-REFERENCE TO RELATED APPLICATION

This non-provisional application claims the benefit of, and priority from U.S. Provisional application 61/289,192 filed Dec. 22, 2009. The contents of such provisional application are hereby incorporated by reference in their entirety as if set forth fully herein.

TECHNICAL FIELD

The present invention relates generally to a sanitizing cleaning wipe. The sanitizing cleaning wipe is formed from a textile structure of a stitch-bonded construction incorporating a relatively low weight substrate with a pattern of spaced-apart parallel stabilizing linear stitch lines with texture-imparting surface yarn segments disposed in a pattern between the linear stitch lines. The texture-imparting surface yarn segments may be formed from a single yarn system arranged in a zigzag pattern between adjacent linear stitch lines or from two or more complementary yarn systems which are each arranged in a zigzag pattern. The surface yarn segments thus define scouring crossing segments which run in angled relation between the linear stitch lines.

BACKGROUND OF THE INVENTION

Anti-bacterial wipe products have recently gained popularity as a mechanism for disinfecting surfaces. Such wipe products typically incorporate a nonwoven sheet which is saturated with a cleaning and sanitizing solution. By way of example only, such wipe products are available at many grocery stores for use by customers to clean the surfaces of grocery carts and baskets before use. Such wipe products are also sold for home use.

In existing wipe products the sheet material acts primarily as a carrier for the disinfecting solution and must have sufficient thickness to avoid tearing during use. Flat or textured non-woven sheets have been used successfully, but such nonwoven sheets must have a relatively substantial weight to avoid falling apart during use. Thus, relatively substantial quantities of fiber are required to form such sheets. The use of additional fiber has the undesired consequence of making the sheets relatively bulky thereby making packaging more difficult. Additional fiber also increases the cost of the final wipe product. Pre-existing wipe products also tend to lack significant surface texture. Thus, scouring ability is relatively limited.

In light of the above, there is a continuing need for an improved wipe product which may act as a carrier for disinfecting solution and which has a scouring surface adapted to promote aggressive cleaning without failure.

SUMMARY OF THE INVENTION

The present invention provides advantages and alternatives over the prior art by providing a wipe that makes use of a multi-bar stitch-bonded construction in which substantially parallel rows of spaced stitches formed from a relatively low denier first yarn are applied through a very low weight spunbonded substrate or the like to stabilize the substrate in a first direction. Surface texturing spun yarns are also applied through the substrate in a zigzag pattern running between the rows of stitches formed by the first yarn. The surface texturing yarns stabilize the substrate transverse to the rows of spaced stitches formed by the first yarn. The surface texturing yarns may be formed from a single yarn system or from two or more cooperating yarn systems. The surface texturing yarns extend substantial distances between stitch points to form extended length float segments across the surface. The float segments are oriented in diagonal relation to the rows of stitches formed by the first yarn. The float segments may be formed over a sinker bar or other spacing structure to provide a degree of spacing between the float segments and the underlying substrate.

According to one exemplary feature, the surface texturing yarns and the low denier first yarns cooperatively form knotted nodes at the intersection stitch points disposed along the rows of stitches formed by the first yarn. These knotted nodes impart an enhanced scrubbing texture to the surface and to the underside of the wipe. The stitches may be applied with the substrate in an overfed condition such that the overall resultant structure has a crepe-like crinkled construction.

In accordance with one exemplary aspect, the present invention provides a disinfecting cleaning wipe of stitch-bonded construction. The wipe includes a stitching substrate of fibrous nonwoven material having a mass per unit area of not more than 30 grams per square meter. A first plurality of stitching yarns are disposed in stitched relation through the stitching substrate in a pattern of substantially parallel linear stitch lines extending in a first direction across the stitching substrate. The linear stitch lines are spaced apart from one another by a distance of at least 3 mm or greater. At least a second plurality of stitching yarns is disposed in stitched relation through the stitching substrate in a repeating zigzag pattern to define a first group of surface yarn float segments extending diagonally between stitch positions at opposing linear stitch lines. The second plurality of stitching yarns is characterized by a linear density greater than the first plurality of stitching yarns. A disinfecting solution at least partially saturates the cleaning wipe.

In accordance with another exemplary aspect, the present invention provides a disinfecting cleaning wipe of stitch-bonded construction. The wipe includes a stitching substrate of fibrous nonwoven material having a mass per unit area of not more than 30 grams per square meter. A first plurality of stitching yarns are disposed in stitched relation through the stitching substrate in a pattern of substantially parallel linear stitch lines extending in a first direction across the stitching substrate. The linear stitch lines are spaced apart from one another by a distance of at least 3 mm or greater. At least a second plurality of stitching yarns is disposed in stitched relation through the stitching substrate in a repeating zigzag pattern to define a first group of surface yarn float segments extending diagonally between stitch positions at opposing linear stitch lines. The second plurality of stitching yarns are textured spun yarns characterized by a linear density greater than the first plurality of stitching yarns. A third plurality of stitching yarns is disposed in stitched relation through the stitching substrate in a repeating zigzag pattern to define a second group of surface yarn float segments extending diagonally between stitch positions at opposing linear stitch lines. The third plurality of stitching yarns are textured spun yarns characterized by a linear density greater than the first plurality of stitching yarns. A disinfecting solution at least partially saturates the cleaning wipe.

In accordance with another exemplary aspect, the present invention provides a method of forming a disinfecting cleaning wipe of stitch-bonded construction adapted to be at least partially saturated with a disinfecting solution. The method includes providing a stitching substrate of fibrous nonwoven material having a mass per unit area of not more than 30 grams per square meter and delivering the stitching substrate to a stitching position in a stitch-bonding apparatus. A first plurality of yarns is stitched through the stitching substrate in a pattern of substantially parallel linear stitch lines extending in a first direction across the stitching substrate. The linear stitch lines are spaced apart from one another by a distance of at least 3 mm or greater. At least a second plurality of yarns is stitched through the stitching substrate in a repeating zigzag pattern to define a first group of surface yarn float segments extending diagonally between stitch positions at opposing linear stitch lines. The second plurality of stitching yarns is characterized by a linear density greater than the first plurality of stitching yarns. The first group of surface yarn float segments have a length of about 5 mm to 12 mm. A disinfecting solution is applied to the wipe.

BRIEF DESCRIPTION OF THE DRAWINGS

The accompanying drawings which are incorporated in and which constitute a part of this specification illustrate several exemplary constructions and procedures in accordance with the present invention and, together with the general description of the invention given above and the detailed description set forth below, serve to explain the principles of the invention wherein.

Figure 1:
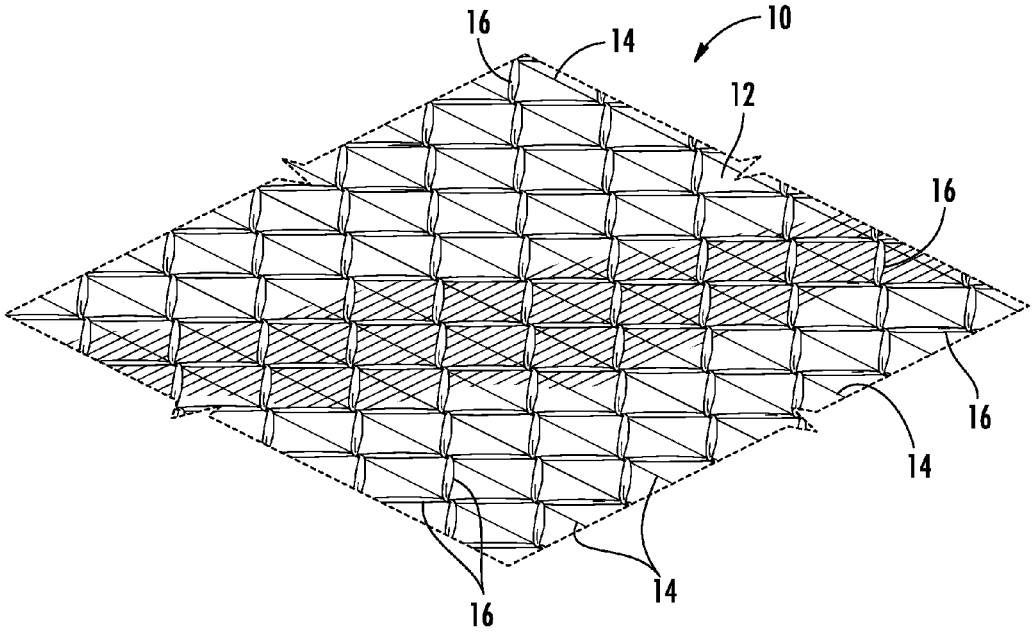
FIG. 1 is a schematic perspective view of a first embodiment of an exemplary disinfecting wipe in accordance with the present invention.

Before the exemplary embodiments of the invention are explained in detail, it is to be understood that the invention is in no way limited in its application or construction to the details and the arrangements of the components set forth in the following description or illustrated in the drawings. Rather, the invention is capable of other embodiments and being practiced or being carried out in various ways. It is intended that the present invention shall extend to all alternatives and modifications as may embrace the general principles of this invention within the full and true spirit and scope thereof. Also, it is to be understood that the phraseology and terminology used herein are for purposes of description only and should not be regarded as limiting. The use herein of terms such as "including" and "comprising" and variations thereof is meant to encompass the items listed thereafter and equivalents thereof as well as additional items and equivalents thereof.

DESCRIPTION OF THE PREFERRED EMBODIMENTS

Reference will now be made to the drawings, wherein to the extent possible like reference numerals are used to designate like elements in the various views. In FIG. 1, a wipe 10 which may be saturated with an alcohol or non-alcohol based disinfecting solution is shown. As will be appreciated, while the wipe 10 is illustrated as being substantially square, virtually any other geometry may likewise be used. Moreover, the wipe 10 may be a segment of an extended length material which is packaged in roll form. In this regard, perforation lines or other structures which facilitate controlled tearing as will be known to those of skill in the art may be disposed at opposing edges of the wipe 10 if desired to facilitate segmentation.

Figure 2:
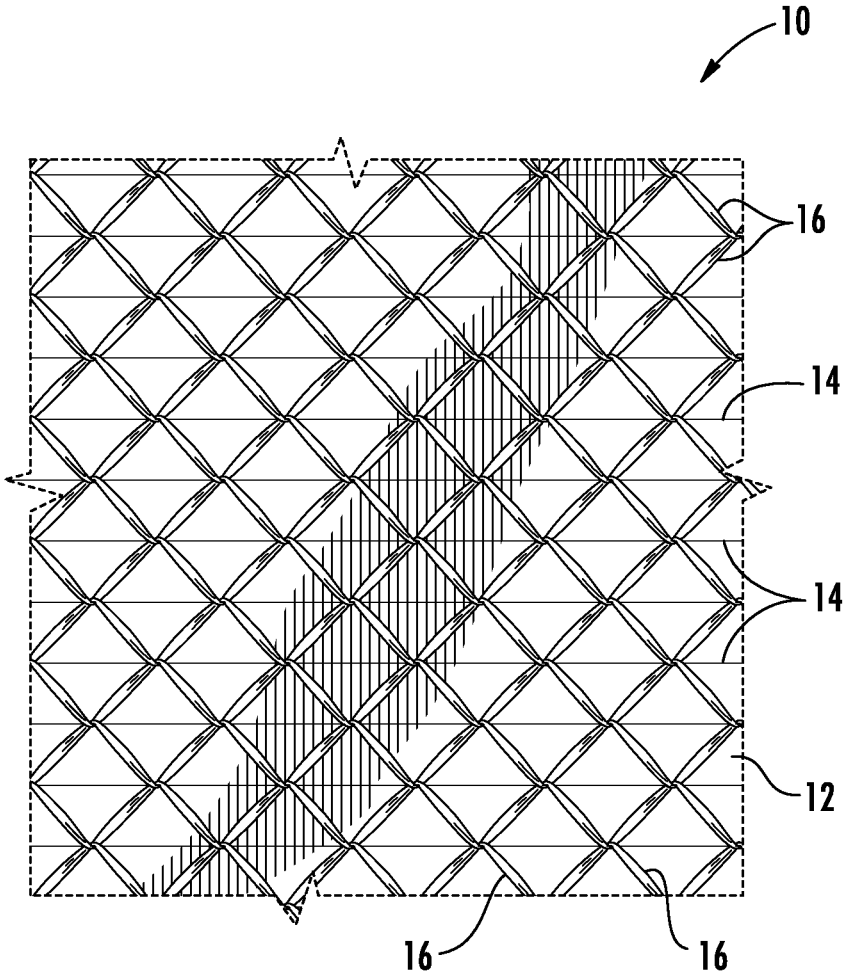
FIG. 2 is a schematic top plan view of the disinfecting wipe of FIG. 1.

As best seen through joint reference to FIGS. 1 and 2, the wipe 10 includes a base substrate 12 with an arrangement of linear stitch lines 14 disposed in parallel, spaced relation to one another. As shown, in the exemplary embodiment the linear stitch lines 14 run in a first direction between opposing edges of the wipe 10. The linear stitch lines 14 may be in the form of chain stitches formed from relatively low denier stitching yarns in a manner as will be described more fully hereinafter. However, other linear stitching patterns such as tricot stitches and the like may likewise be used. As best seen in FIG. 2, the wipe 10 includes surface yarn segments 16 stitched in zigzag crossing relation between opposing linear stitch lines 14. The yarn segments 16 are formed from yarn which is significantly thicker than the base substrate 12 or the yarn forming the linear stitch lines 14. Thus, the yarn segments 16 impart a defined texturing pattern across an upper surface of the wipe 10. In this regard, while the illustrated texturing pattern of FIGS. 1 and 2 is a pattern of diamond shapes, any number of other patterns such as hexagons or the like formed by yarn segments running diagonally between opposing stitch lines may likewise be used if desired.

Figure 3:
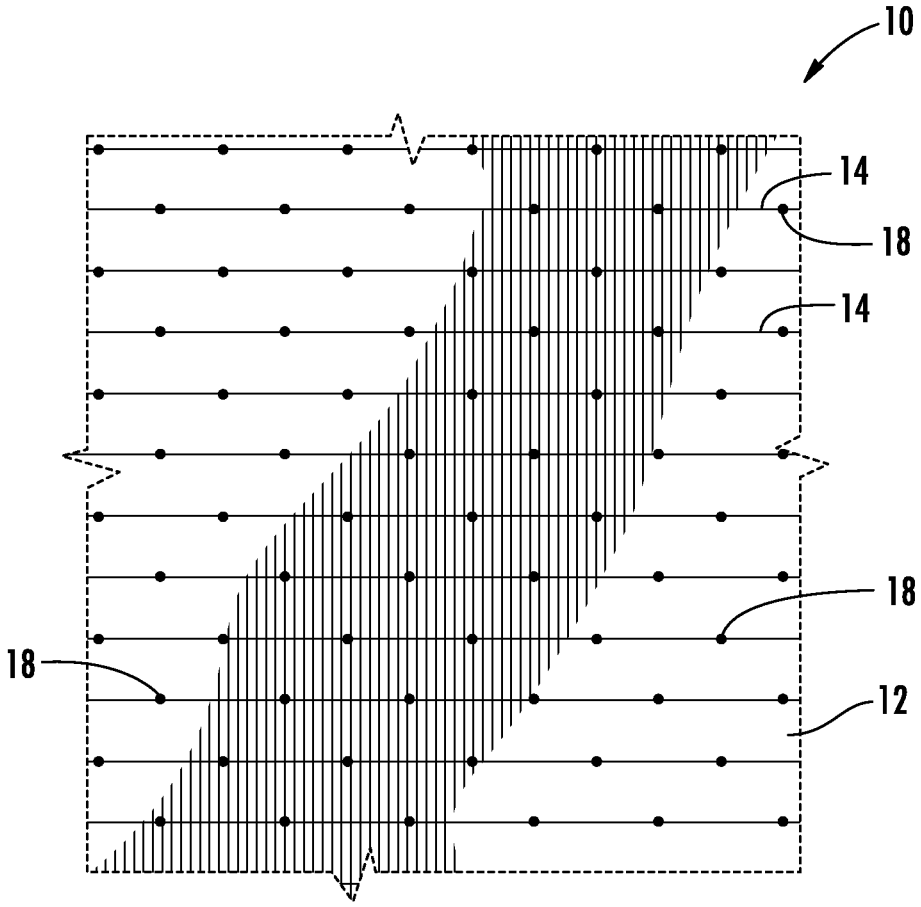
FIG. 3 is a schematic bottom plan view of the disinfecting wipe of FIG. 1.

As best seen through joint reference to FIGS. 2 and 3, the underside of the wipe 10 which faces away from the upper patterned side includes an arrangement of knotted nodes 18 disposed at positions along the linear stitch lines 14 corresponding to the positions where the yarn segments 16 intersect with the linear stitch lines 14. These knotted nodes 18 provide a secondary scouring surface across the upper patterned side and the underside.

As indicated previously, the exemplary wipe 10 according to the present invention may be formed by so called stitch-bonding (also referred to as stitch knitting) techniques. In such a process, stitching yarns are passed in stitching relation through a substrate formed from one or more layers of material so as to form a coordinated arrangement of surface stitches. Such a process is described generally in U.S. Pat. No. 6,855,392 to Wildeman et al. which is incorporated herein by reference.

Figure 4:
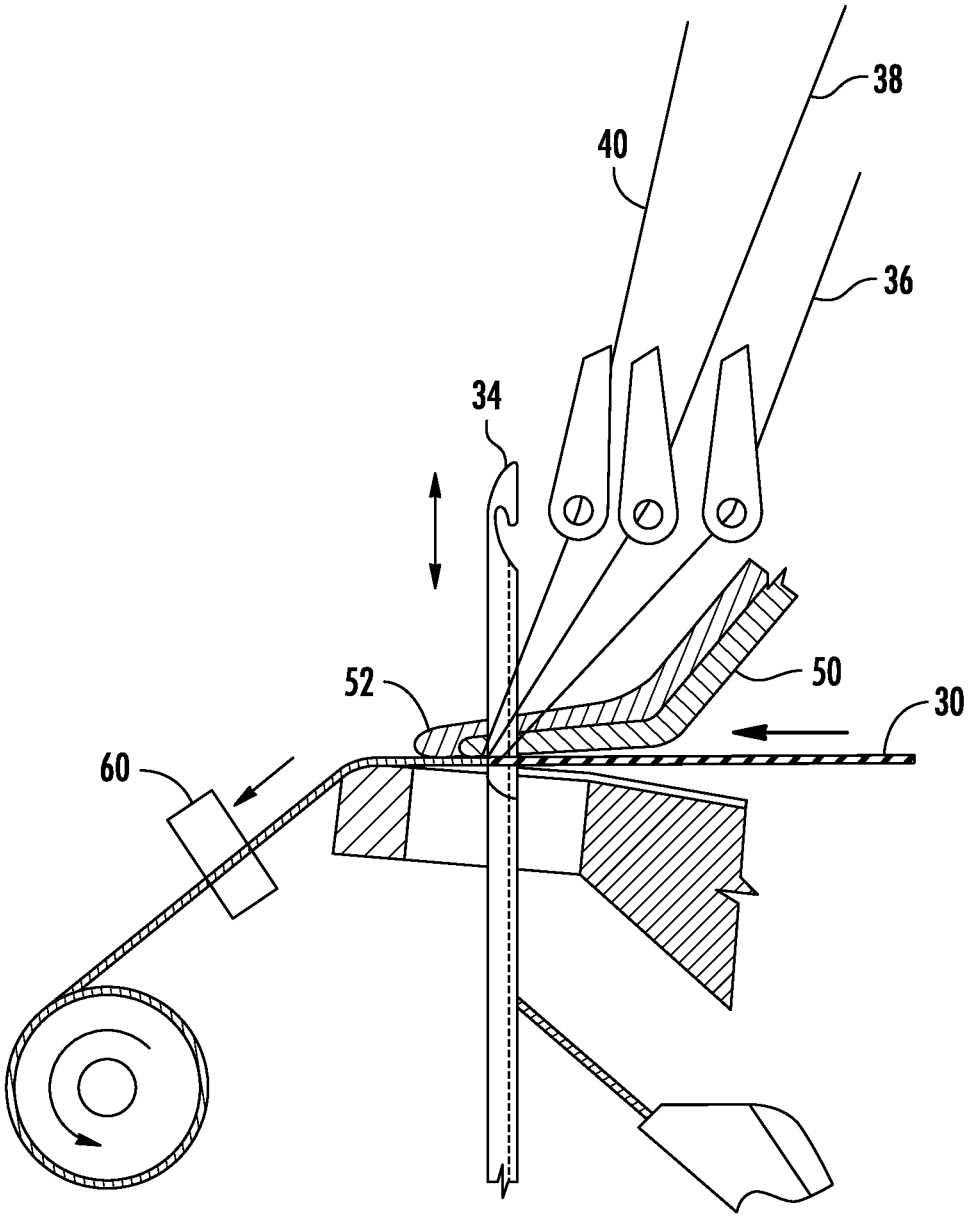
FIG. 4 illustrates schematically a three-bar stitch bonding system and take-up for forming the disinfecting wipe of FIG. 1 by stitching a pattern of machine direction stabilizing yarns and surface texturing yarns through a light-weight substrate material.
Figure 5:
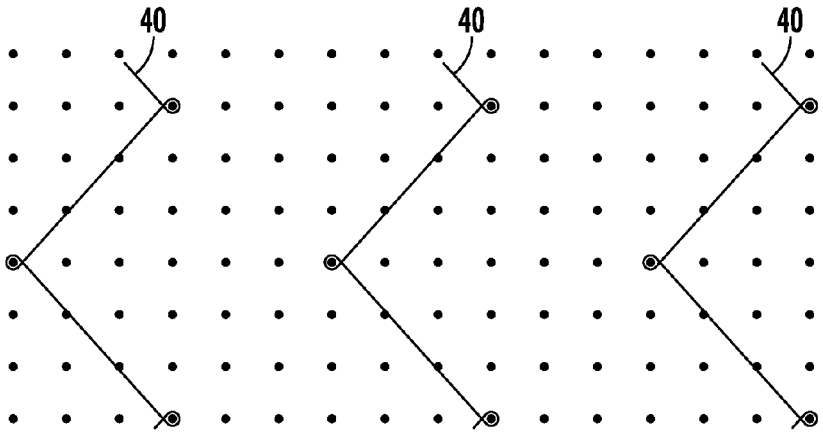
FIG. 5 illustrates schematically an exemplary back bar zigzag stitch pattern for stitching a surface texturing yarn applied by the three-bar system of FIG. 4.
Figure 6:
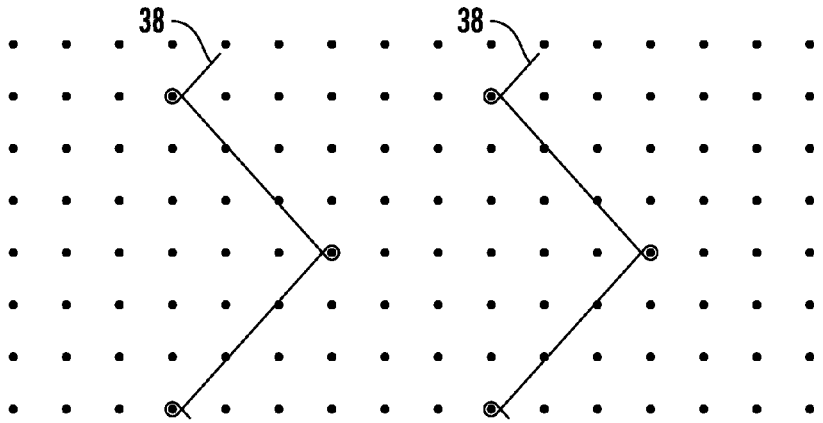
FIG. 6 illustrates schematically an exemplary middle bar zigzag stitch pattern for stitching a surface texturing yarn applied by the three-bar system of FIG. 4.
Figure 7:
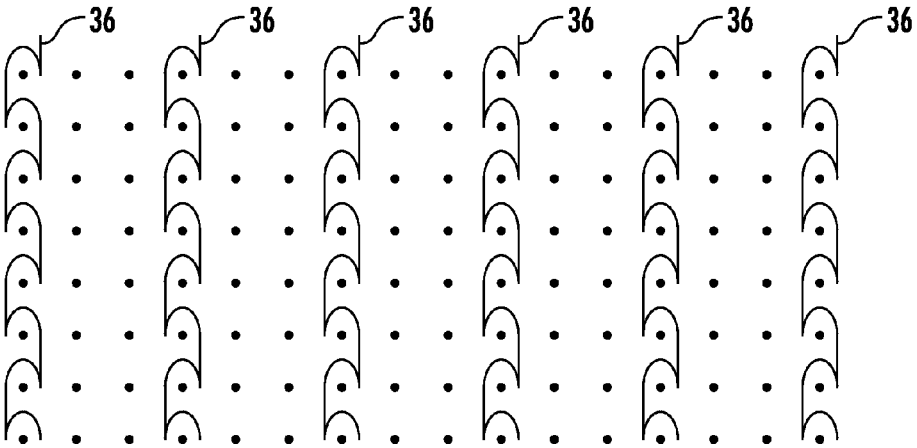
FIG. 7 illustrates schematically an exemplary front bar chain stitch pattern for stitching a machine direction stabilizing yarn applied by the three-bar system of FIG. 4.

By way of example only, one method contemplated for formation of a wipe 10 in accordance with the present invention involves a so called three-bar stitch-bonding procedure shown schematically in FIG. 4. In the illustrated exemplary practice, one or more plies of a substrate material 30 of fibrous nonwoven construction such as a spunbonded fleece or the like is conveyed to a stitch-forming position in the direction indicated by the arrows. By way of example only, the substrate material 30 may be a spunbonded polyester or polypropylene fleece having a mass per unit area of about 5 to about 30 grams per square meter and most preferably about 17 grams per square meter. However, other materials with higher or lower weights may also be used. While FIG. 4 illustrates the use of a single ply of substrate material, it is contemplated that multiple plies also may be used if desired.

As will be appreciated by those of skill in the art, during the stitch-bonding process a needle 34 (shown in greatly exaggerated dimension) pierces the substrate material 30 and engages stitching yarns delivered into position by the yarn guides such that the stitching yarns are captured within a hook portion of the needle 34. As the needle is reciprocated downwardly, a closing element such as a closing wire which moves relative to the needle 34 closes the hook portion to hold the stitching yarns therein. With the hook portion closed, the captured stitching yarns are pulled through the interior of an immediately preceding yarn loop disposed around the shank of the needle 34 at a position below the substrate material 30. As the captured stitching yarns are pulled through the interior of the preceding yarn loop a stitch is formed which is knocked off of the needle 34. As the needle 34 is raised back through the substrate material 30, the hook portion is reopened and a new yarn loop moves out of the hook portion and is held around the shank of the needle 34 for acceptance of captured yarns and formation of a subsequent stitch during the next down stroke. During this process individual stitching yarns may be held at a single needle 34 or may be shifted back and forth laterally between needles.

It has been found that it may be desirable to deliver the substrate material at a slight overfeed condition of about 10% to about 25% such that excess substrate material is delivered to the stitching position. According to one exemplary practice, an overfeed of about 19% may be used. However, greater or lesser overfeed levels may likewise be used. The presence of such excess substrate material causes the substrate to slightly pucker or crinkle slightly during the stitching operation thereby providing a potentially desirable crepe-like texturing character. Of course, other delivery rates may also be used.

The stitch bonding machine typically incorporates a row of reciprocating needles 34 (only one shown) extending in adjacent relation to one another across the width of the substrate material 30 substantially transverse to the direction of movement of the substrate material 30. The so called gauge or needle density in the cross machine direction maybe adjusted as desired. By way of example only, and not limitation, it is contemplated that the gauge may be in the range of about 7 to 28 needles per inch and will more preferably be about 12 to 16 and will most preferably be about 14 needles per inch, although higher and lower needle densities may likewise be used if desired. By way of example only, and not limitation, it is contemplated that the stitch bonding machine may be set to apply about 8 to 16 stitches per inch and most preferably about 12 stitches per inch in the machine direction (also known as courses per inch or CPI). As will be described further hereinafter, only selected needles are threaded and needles that are not used are preferably removed.

Referring jointly to FIGS. 4-7, according to a contemplated practice, three yarn systems (i.e. three bars) are used to form stitches through the substrate material 30. A first group of relatively small denier machine direction stabilizing yarns 36 of low stretchability such as a commodity polyester yarn having a linear density of about 20 to about 150 denier is carried by a front guide. By way of example only, and not limitation, one exemplary machine direction stabilizing yarn is a 40 denier 12 filament (40/12) semi-dull round polyester. Of course, higher or lower denier levels may be used if desired. A second group of yarns 38 such as polyester textured spun yarns having a linear density of about 70 to about 400 denier defining surface texturing yarns for use in forming the surface yarn segments 16 is carried by a middle guide. A third group of yarns 40 such as polyester textured spun yarns having a linear density of about 70 to about 400 denier defining surface texturing yarns for use in forming the surface yarn segments 16 is carried by a back guide. According to one exemplary practice, the second and third groups of yarns 38, 40 may each be 150 denier, 288 filament textured polyester yarns. However, higher or lower denier levels may be used. Moreover, it is contemplated that the second and third groups of yarns 38, 40 may be either similar or dissimilar in construction.

As best illustrated through joint reference to FIGS. 5-8, in the illustrated exemplary construction, the first group of yarns 36 is stitched through the substrate material 30 in a pattern of substantially parallel, spaced apart chain stitches extending along the machine direction in a partially threaded arrangement to form the linear stitch lines 14. The distance between the linear stitch lines is preferably at least about 3 mm and will more preferably be in the range of about 5 mm to about 12 mm although greater or lesser spacing distances may be used. In the illustrated exemplary construction the first group of yarns 36 is threaded in a so called "1 miss 2" pattern with every third needle being engaged. Intermediate needles are preferably removed such that segments of the substrate material 30 between the linear stitch lines 14 are not perforated. The exemplary stitch pattern notation for the front bar is (1-0, 0-1//).

In the illustrated exemplary construction the second and third groups of yarns 38, 40 are stitched in mirror image zigzag patterns using a "1 miss 5" pattern with every sixth needle being engaged with stitches formed at the same needles that engage the first group of yarns 36. By way of example only, and not limitation, the back bar (FIG. 5) may be threaded in a "1 miss 5" pattern and may be stitched according to a stitch pattern notation of (3-4, 3-3, 2-2, 1-0, 1-1, 2-2//) with a 6 course repeat of chain links. The middle bar (FIG. 6) may be threaded in a "skip 3, 1 miss 5" pattern and may be stitched according to a stitch pattern notation of (1-0, 1-1, 2-2, 3-4, 3-3, 2-2//) with a 6 course repeat of chain links.

Figure 8:
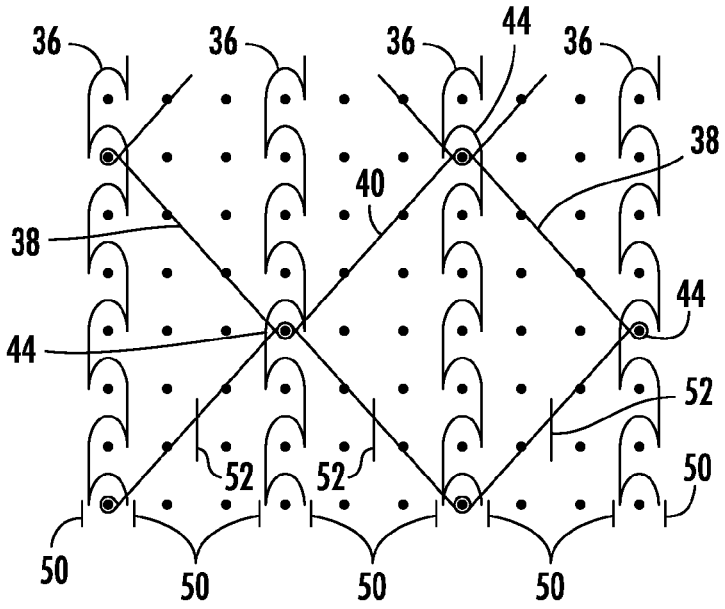
FIG. 8 illustrates schematically a coordinated stitch pattern combining the stitch patterns of FIGS. 5-7.

As best seen through joint reference to FIGS. 2, 3 and 8, using this arrangement the second and third groups of yarns 38, 40 form a generally diamond shaped pattern with corners of the diamond pattern positioned at the knotted nodes 18 formed at the mutual stitch positions of the three yarn groups. It has been found that this arrangement provides substantial stability in both the machine direction and in the cross-machine direction despite the fact that the stitching yarns are substantially dispersed across the surface of the resultant structure. Moreover, the knotted nodes 18 provide an arrangement of raised scrubbing elements to aid in cleaning.

As illustrated, in the exemplary arrangement the second and third groups of yarns 38, 40 define surface yarn segments 16 which extend diagonally substantial distances between the knotted nodes 18 thereby defining extended length float segments. In this regard, the term "float segment" denotes that the diagonal surface yarn segments are not locked down between their stitch positions. The length of the float segments between the knotted nodes is preferably about 4 mm or greater and will more preferably be in the range of about 5 mm-15 mm although greater or lesser lights may be used if desired. According to the potentially preferred practice, these float segments are slightly longer than the straight line distance between the knotted nodes 18 such that the float segments can be pulled slightly away from the underlying substrate. This arrangement is believed to impart improved texture to the structure. Dirt collection also may be improved. Specifically, in accordance with the potentially preferred practice, the second and third groups of yarns 38, 40 are characterized by relatively high filament counts (about 288 filaments per yarn) such that the filaments may bloom apart from one another so as to yield increased surface area to capture dirt and/or to hold disinfecting fluid between the filaments.

Figure 9:
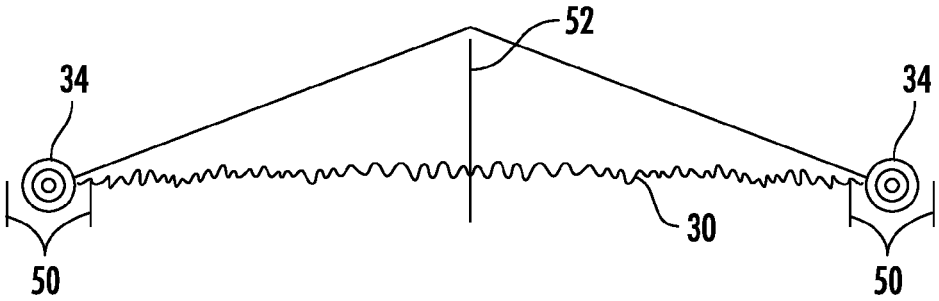
FIG. 9 illustrates schematically an arrangement of pile sinkers and hold down sinkers to generate raised float segments between stitch points.

As best seen through joint reference to FIGS. 4, 8 and 9, according to a potentially preferred practice, in order to provide surface yarn segments 16 forming elevated float segments, the substrate material 30 may be held down on either side of each needle 34 by a pair of low profile hold down sinkers 50 (FIG. 8). A higher profile pile sinker 52 is located at an intermediate position between threaded needles such that the yarns 38, 40 which form the surface yarn segments 16 pass over the pile sinker 52 between stitching positions. This results in a slight excess of crossing yarn between the stitch positions such that the yarn is not held tightly against the surface of the substrate material 30. This relaxed state may also aid in allowing the surface yarn segments 16 to bloom to an enhanced diameter. Moreover, by being spaced apart from the surface of the substrate material 30, the undersides of the float segments may be useful in dirt collection. By way of example only, a pile sinker height of about 1.5 mm may be useful although this level may be higher or lower if desired.

According to one exemplary practice, in order to impart functional tear lines across the fabric, the stitch-bonded fabric may be periodically subjected to localized melt fusion and/or perforation at a station 60 downstream from the needling position (FIG. 4). As will be appreciated, the application of a melt fusion line and/or localized perforation line defines a stress concentrator to facilitate controlled tearing from a roll during use. In the event that segmenting perforation lines are applied, the zigzag stitching yarns between specific adjacent chain stitches may be intermittently disengaged for brief spans. This would leave zones in the machine direction which are substantially free from diagonal surface yarn segments. A perforation device can then be registered to cut through the linear stitch lines. The material will have sufficient strength to permit rolling. However, application of a shear force along the perforation line will cause controlled tearing.

Figure 10:
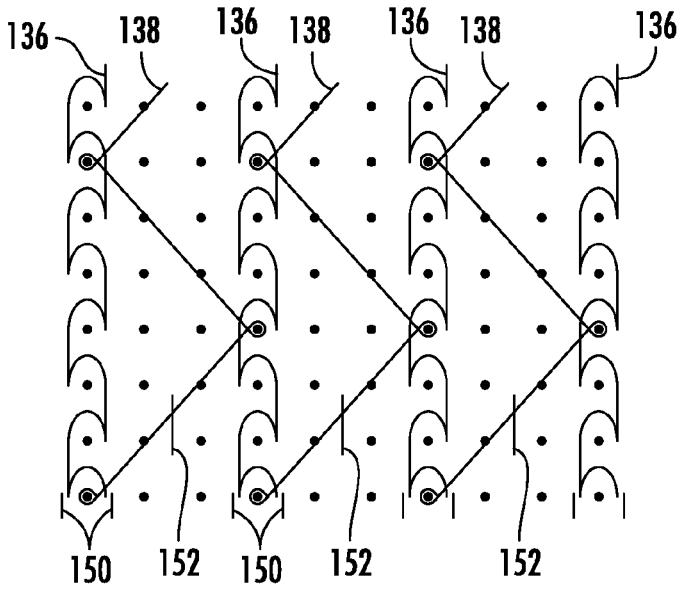
FIG. 10 illustrates schematically an alternative two-bar stitch pattern.
Figure 11:
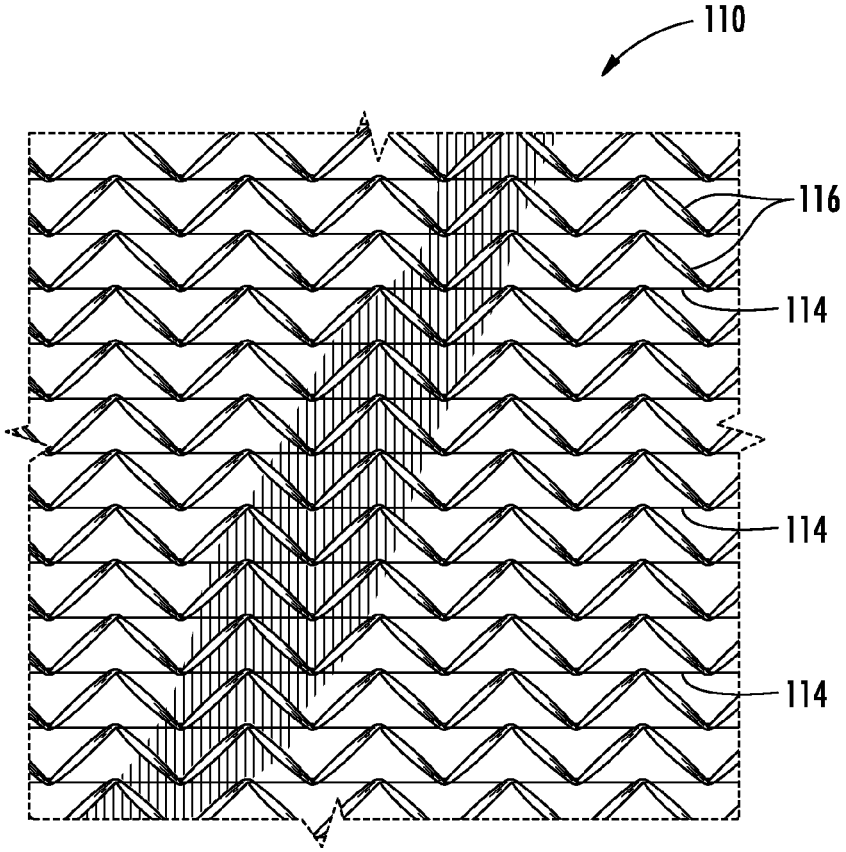
FIG. 11 is a schematic top plan view of the disinfecting wipe formed using the two-bar stitch pattern of FIG. 10.

While a three-bar system as described may be particularly desirable, it is likewise contemplated that a two-bar system also may be used. By way of example only and not limitation, an exemplary two-bar pattern is shown in FIG. 10. In this exemplary pattern, a first group of yarns 136 such as a relatively low denier commodity polyester yarn having a linear density of about 20 to about 150 denier and most preferably about 40 denier forms a chain stitch pattern to define an array of spaced-apart linear stitch lines 114 through as substrate material as previously described in a wipe 110 (FIG. 11). A second group of yarns 138 such as polyester textured spun yarns as previously described is threaded in a "1 in 2 out" arrangement to form a zigzag pattern running between adjacent linear stitch lines 114 to form a pattern of diagonal surface yarn segments 116 across an upper face of the wipe 110. The spacing between the linear stitch lines 114 is preferably at least about 3 mm and will more preferably be in the range of about 4 mm to about 12 mm although greater or lesser spacing distances may be used. The length of the diagonal surface yarn segments 116 (i.e float segments) between stitch positions is preferably about 4 mm or greater and will more preferably be in the range of about 5 mm-15 mm although greater or lesser lengths may be used if desired. As shown, the surface yarn segments 116 thus form a chevron pattern across the surface of the wipe 110. As with the prior arrangement, substantial strength is provided in both the machine direction and the cross-machine direction despite the relatively disperse arrangement of yarns. Of course, the needles between the linear stitch lines 114 may be removed to avoid peroration of the substrate material in those zones.

In practice, the constructions described may be saturated with a disinfecting solution by techniques such as spraying, immersion or the like as will be known to those of skill in the art and packaged as rolls with periodic tear lines to permit withdrawal and use for cleaning and disinfecting purposes.

Of course, variations and modifications of the foregoing are within the scope of the present invention. Thus, it is to be understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments and equivalents to the extent permitted by the prior art.

The invention claimed is:

1. A disinfecting cleaning wipe of stitch-bonded construction comprising:

a stitching substrate of fibrous nonwoven material having a mass per unit area of not more than 30 grams per square meter;

a first plurality of stitching yarns disposed in stitched relation through the stitching substrate in a pattern of substantially parallel linear stitch lines extending in a first direction across the stitching substrate, wherein the linear stitch lines are spaced apart from one another by a distance of at least 3 mm or greater;

at least a second plurality of stitching yarns disposed in stitched relation through the stitching substrate in a repeating zigzag pattern to define a first group of surface yarn float segments extending diagonally between stitch positions at opposing linear stitch lines, wherein the second plurality of stitching yarns is characterized by a linear density greater than the first plurality of stitching yarns, wherein the stitching substrate of fibrous nonwoven material is spunbond polypropylene characterized by a mass per unit area of about 10 to 20 grams per square meter, wherein the linear stitch lines are spaced apart from one another by a distance of about 4 mm to 10 mm and wherein the first group of surface yarn float segments are formed from textured spun yarns and have a length of about 5 mm to 12 mm between stitches; and a disinfecting solution at least partially saturating the cleaning wipe.

2. The disinfecting cleaning wipe as recited in claim 1, wherein the linear stitch lines comprise a plurality of chain stitches.

3. A disinfecting cleaning wipe of stitch-bonded construction comprising:

a stitching substrate of fibrous nonwoven material having a mass per unit area of not more than 30 grams per square meter;

a first plurality of stitching yarns disposed in stitched relation through the stitching substrate in a pattern of substantially parallel linear stitch lines extending in a first direction across the stitching substrate, wherein the linear stitch lines are spaced apart from one another by a distance of at least 4 mm or greater, a second plurality of stitching yarns disposed in stitched relation through the stitching substrate in a repeating zigzag pattern to define a first group of surface yarn float segments extending diagonally between stitch positions at opposing linear stitch lines, wherein the second plurality of stitching yarns are textured spun yarns characterized by a linear density greater than the first plurality of stitching yarns;

a third plurality of stitching yarns disposed in stitched relation through the stitching substrate in a repeating zigzag pattern to define a second group of surface yarn float segments extending diagonally between stitch positions at opposing linear stitch lines, wherein the third plurality of stitching yarns are textured spun yarns characterized by a linear density greater than the first plurality of stitching yarns; and a disinfecting solution at least partially saturating the cleaning wipe.

4. The disinfecting cleaning wipe as recited in claim 3, wherein the stitching substrate of fibrous nonwoven material is characterized by a mass per unit area of not more than 25 grams per square meter.

5. The disinfecting cleaning wipe as recited in claim 3, wherein the stitching substrate of fibrous nonwoven material is polypropylene characterized by a mass per unit area of about 10 to 20 grams per square meter.

6. The disinfecting cleaning wipe as recited in claim 3, wherein the linear stitch lines comprise a plurality of chain stitches.

7. The disinfecting cleaning wipe as recited in claim 3, wherein the linear stitch lines are spaced apart from one another by a distance of 4 mm to 10 mm.

8. The disinfecting cleaning wipe as recited in claim 3, wherein the first group of surface yarn float segments have a length of about 5 mm or greater and the second group of surface yarn float segments have a length of about 5 mm or greater.

9. The disinfecting cleaning wipe as recited in claim 3, wherein the first group of surface yarn float segments have a length of about 5 mm to 12 mm and wherein the second group of surface yarn float segments have a length of about 5 mm to 12 mm.

10. The disinfecting cleaning wipe as recited in claim 3, wherein the stitching substrate of fibrous nonwoven material is spunbond polypropylene characterized by a mass per unit area of about 10 to 20 grams per square meter, wherein the linear stitch lines are spaced apart from one another by a distance of about 4 mm to 10 mm and wherein the first group of surface yarn float segments have a length of about 5 mm to 12 mm between stitches, and wherein the second group of surface yarn float segments have a length of about 5 mm to 12 mm between stitches.

* * * * *